US007301551B2

(12) United States Patent
Lee et al.

(10) Patent No.: US 7,301,551 B2
(45) Date of Patent: Nov. 27, 2007

(54) THERMAL IMAGE FORMING APPARATUS

(75) Inventors: Yong-Duk Lee, Gunpo-si (KR); Jong-Sung Jung, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 296 days.

(21) Appl. No.: 11/183,775

(22) Filed: Jul. 19, 2005

(65) Prior Publication Data

US 2006/0061648 A1 Mar. 23, 2006

(30) Foreign Application Priority Data

Sep. 20, 2004 (KR) ..... 10-2004-0075063

(51) Int. Cl.
*B41J 2/32* (2006.01)

(52) U.S. Cl. ..... 347/197

(58) Field of Classification Search ..... 347/197, 347/171–172, 174, 175, 176, 177, 198, 218, 347/104; 400/188, 120.16, 149, 150
See application file for complete search history.

(56) References Cited

U.S. PATENT DOCUMENTS 6,296,405 B1 * 10/2001 Brewington et al. ..... 400/188
6,447,182 B2 * 9/2002 Brewington et al. ..... 400/188
6,601,952 B2 * 8/2003 Sugioka et al. ..... 347/104

FOREIGN PATENT DOCUMENTS

| | | |
|---|---|---|
| JP | H05-238073 | 9/1993 |
| JP | H05-338274 | 12/1993 |
| JP | H08-224933 | 9/1996 |
| JP | H09-086007 | 3/1997 |
| JP | H10-076713 | 3/1998 |
| JP | 2001-260515 | 9/2001 |
| JP | 2001-310503 | 11/2001 |

* cited by examiner

*Primary Examiner*—K. Feggins
(74) *Attorney, Agent, or Firm*—Roylance, Abrams, Berdo & Goodman LLP

(57) ABSTRACT

A thermal image forming apparatus is provided. A platen roller supports a recording medium having first and second sides opposite to each other. A recording head includes a heating part that applies heat to the recording medium for image formation. The recording head rotates around the platen roller to move the heating part to first and second locations respectively facing the first and second sides of the recording medium. A conveying part conveys the recording medium. When the recording head is positioned at the first and second locations, locations of the heating part are symmetrical with each other with respect to a reference line, which passes through the conveying part and a center of the platen roller.

16 Claims, 10 Drawing Sheets

THERMAL IMAGE FORMING APPARATUS

CROSS-REFERENCE TO RELATED APPLICATIONS

This application claims priority from Korean Patent Application No. 10-2004-0075063, filed on Sep. 20, 2004, the entire disclosure of which is hereby incorporated by reference.

BACKGROUND OF THE INVENTION

1. Field of the Invention

The present invention relates to an image forming apparatus. More particularly, the present invention relates to a thermal image forming apparatus capable of forming good quality and uniform images on both sides of a recording medium.

2. Description of the Related Art

In order to print an image on both sides of a recording medium, typically two recording heads are provided at positions which face both sides of the recording medium. In this case, however, such an image forming apparatus becomes relatively expensive. In another method for double-sided printing, one recording head is provided and the recording head is designed to face the first and second sides of the recording medium in turn. In this case, two approaches may be considered. A first approach is to fix the recording head and invert the recording medium. A second approach is to move the recording head to the positions facing the first and second sides of the recording medium. However, these two approaches are also expensive, have complicated transfer path, and often do not print uniform images on both sides of the medium.

Accordingly, there is a need for an improved thermal image forming apparatus having a simplified transfer path capable of forming good quality and uniform images on both sides of a recording medium which is relatively inexpensive.

SUMMARY OF THE INVENTION

An aspect of the present invention is to solve at least the above problems and/or disadvantages and to provide at least the advantages described below. Accordingly, an aspect of the present invention is to provide a thermal image forming apparatus having one recording head, in which a double-sided printing can be achieved by alternately moving the recording head to first and second positions facing first and second sides of a recording medium.

According to an aspect of the present invention, there is provided a thermal image forming apparatus including a platen roller supporting a recording medium. The recording medium has first and second sides opposite to each other. A recording head includes a heating part which applies heat to the recording medium for image formation. The recording head rotates around the platen roller to move the heating part to first and second locations respectively facing the first and second sides of the recording medium. A conveying part conveys the recording medium. When the recording head is positioned at the first and second locations, locations of the heating part are symmetrical with each other with respect to a reference line. The reference line passes through the conveying part and a center of the platen roller.

A rotation center of the recording head may be positioned at a location that is eccentric from the center of the platen roller along the reference line by a distance corresponding to a location deviation of the heating part with respect to a normal line connecting the center of the platen roller and the heating part.

The second location may be positioned at a location that is rotated from the first location by about 180°.

The conveying part may include a drive roller and a driven roller which rotate while in engagement with each other, and the reference line is a line connecting the center of the platen roller and a contact portion between the drive roller and the driven roller.

The image forming apparatus may further include a first path through which the recording medium is initially fed and a second path in which the recording head and the platen roller are arranged. A third path branches from a connecting portion of the first and second paths. The recording medium is discharged through the third path after printing is finished. The conveying part is arranged in the connecting portion and conveys the recording medium in a first direction so as to form an image thereon or in a second direction so as to match a print start location.

The image forming apparatus may further include a pair of bushings having an inner circumference portion and an outer circumference portion. The inner circumference portion rotatably supports the platen roller. The outer circumference portion is located eccentrically from the inner circumference portion by a location deviation at the first location of the heating part. A pair of support brackets are rotatably arranged in the outer circumference portion of the bushings. The support brackets support both ends of the recording head and a shaft has one end coupled to the recording head and the other end inserted into a through hole formed at the support bracket. A motor rotates the rotation cam. The rotation cam pushes the shaft to rotate the support bracket.

The bushing may further include a second outer circumference portion that is concentric with the first outer circumference portion, wherein the rotation cam is rotatably arranged in the second outer circumference portion.

The image forming apparatus may further include first and second locking grooves provided on the support bracket. A locking member is selectively coupled to the first and second locking grooves to lock the recording head to positions facing the first and second sides of the recording medium. A first elastic member elastically biases the locking member in a direction for coupling the first and second locking grooves. A second elastic member elastically biases the recording head in a direction for contacting with the platen roller. The recording head is coupled to the support bracket so that the recording head moves in a direction for contacting with the platen roller or in a direction to separate from the platen roller. The through hole is formed in a substantially arcuate shape which is centered on a rotating axis of the recording medium. When the locking member is locked into the first or second locking grooves, the rotation cam comes into contact with the shaft so that the recording head moves into contact with the platen roller or separates from the platen roller. When the locking member unlocks from the first or second locking grooves, the rotation cam moves into contact with the shaft and rotates the support bracket.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
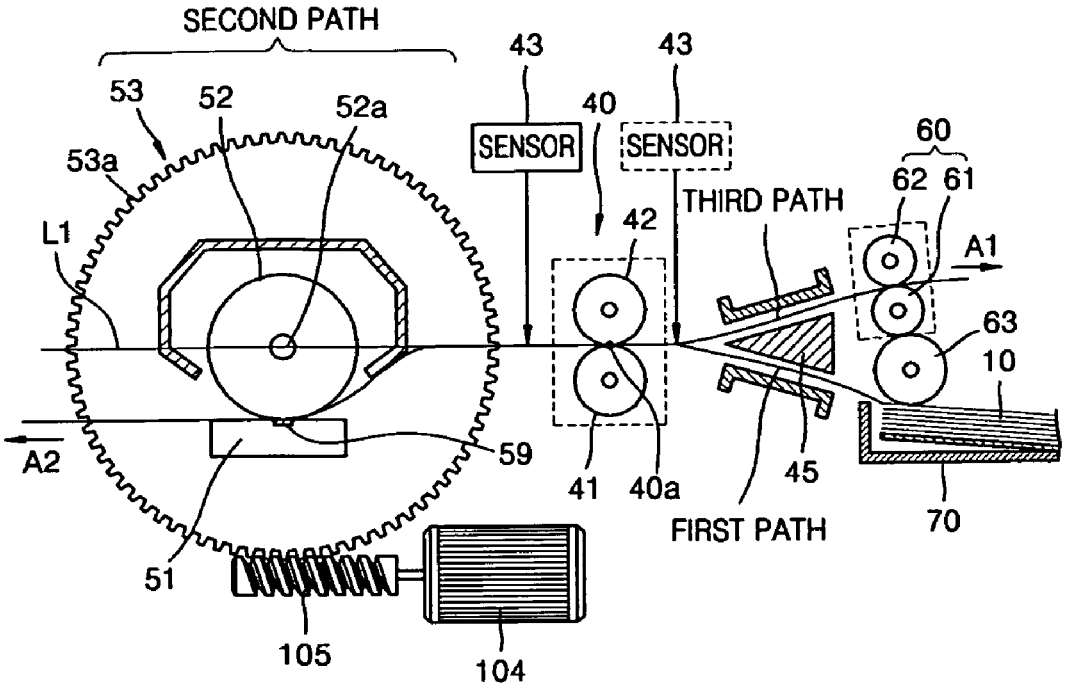
FIGS. 1 and 2 are views illustrating a thermal image forming apparatus according to an exemplary embodiment of the present invention.
Figure 2:
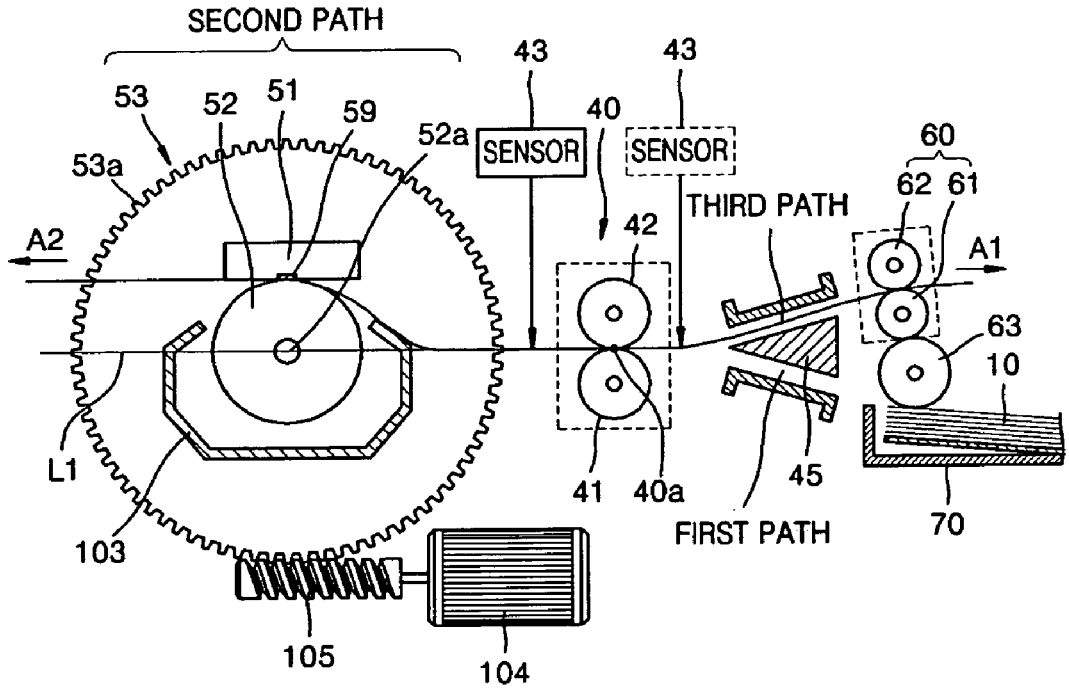

FIGS. 1 and 2 are views of an image forming apparatus according to an embodiment of the present invention. Referring to FIGS. 1 and 2, an image forming apparatus has a first path, a second path and a third path, through which a recording medium 10 is conveyed. The first path is a feed path through which the recording medium 10 is conveyed toward the second path. The second path is a path through which printing is performed on the recording medium 10. The third path branches from a point proximate a connecting portion, wherethe first and second paths converge. The third path is a path through which the recording medium 10 is discharged during printing or when an image is completely printed on first and second sides of the recording medium.

A recording medium guide 45 is disposed between the first path and the third path. The recording medium guide 45 guides the recording medium fed through the first path toward the second path and also guides the recording medium 10 from the second path to the third path during the printing. A conveying part 40 conveys the recording medium 10 from the first path to the second path, from the second path to the third path, and from the third path to the second path in this order.

Figure 9:
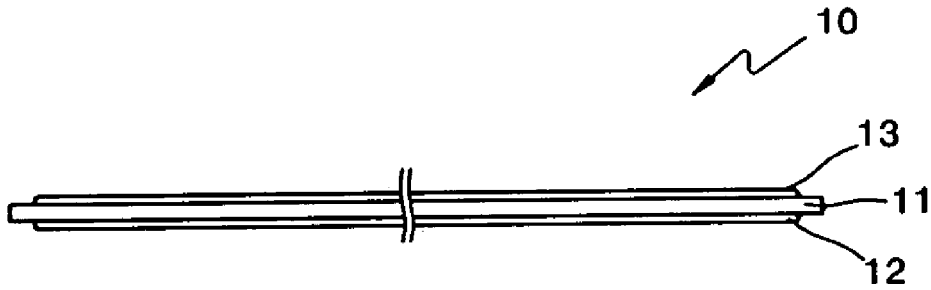
FIG. 9 is a sectional view of a recording medium according to an embodiment of the present invention.

The recording medium 10 preferably used in the image forming apparatus may have a structure shown in FIG. 9. The recording medium 10 includes a base sheet 11 having first and second sides, and color ink layers 12 and 13 formed on the first and second sides. Each of the ink layers 12 and 13 may have a single-layer structure for single color or a multi-layer structure for two or more colors. For example, the ink layer 12 formed on the first side may be provided with two stacked layers for yellow and magenta, and the ink layer 13 formed on the second side may be provided with a single layer for cyan.

The image forming apparatus uses the recording medium 10, which produces color images provided by the image formation with respect to the first and second sides, for double-sided printing. A thermal image forming apparatus is provided and has a recording head 51 which includes a heating part 59 which heats the recording medium 10 so as to form the image.

An image forming part 50 including the recording head 51 and a platen roller 52 is disposed on the second path. The platen roller 52 faces the recording head 51 to support the recording medium 10 and applies compression thereto. In this exemplary embodiment, the recording head 51 rotates around the platen roller 52 and moves to the first and second locations that respectively face the first and second sides of the recording medium 10. For this purpose, the image forming apparatus includes a support bracket 53. The recording head 51 is locked to the support bracket 53. A gear 53*a* is provided on an outer periphery of the support bracket 53. A motor 104 includes a worm gear 105 engaged with the gear 53*a*. The motor 104 rotates the support bracket 53. The recording head 51 processes the periphery of the platen roller 52 and moves to the first and second positions, as shown in FIGS. 1 and 2.

The movement of the recording head 51 is achieved when the recording medium 10 is not positioned along the second path. For example, before the recording medium 10 is fed from the first path, or when the recording medium 10 is conveyed to the third path after printing on the first side, the recording medium 10 does not return to the second path.

A discharge part 60, including a discharge roller 61 and an idle roller 62 engaged therewith, is provided on the third path so as to discharge the recording medium 10. A pick-up roller 63 and the discharge roller 61 are in contact with each other and are driven by one drive motor (not shown).

The recording medium 10 is picked up from a cassette 70 and fed to the conveying part 40 through the first path. The conveying part 40 conveys the recording medium 10 in a second direction A2, so that the recording medium 10 is fed to the second path. As shown in FIG. 1, the recording head 51 is positioned at the first location and faces the first side of the recording medium 10. When the recording medium 10 is positioned at the print start location, the conveying part 40 again conveys the recording medium 10 in the first direction A1. The recording medium 10 is conveyed from the second path to the third path. During that time, the recording head 51 heats the first side of the recording medium 10, thereby printing the image thereon. After finishing printing on the first side, the motor 104 rotates the support bracket 53, so that the recording head 51 is moved to the second location facing the second side of the recording medium 10. The conveying part 40 conveys the recording medium 10 in the second direction A2, so that the recording medium 10 is fed to the second path. When the recording medium 10 is positioned at the print start location, the conveying part 40 conveys the recording medium 10 in the first direction A1. During that time, the printing on the second side of the recording medium 10 is performed. After finishing the printing on the second side of the recording medium 10, the recording medium 10 is discharged out of the image forming apparatus by the discharge part 60. If the motor 104 rotates in a reverse direction, the recording head 51 returns to the first location again.

As shown in FIG. 9, the base sheet 11 of the recording medium 10 may be formed of a transparent material. An opaque layer may be formed on one ink layer, for example the ink layer 12. Additionally, in the ink layer 13, cyan, magenta and yellow images may be overlapped with one another, thereby representing full color images, on ink layer 13.

The thermal image forming apparatus according to exemplary embodiments of the present invention can be used for a double-sided printing, that is, an image formed on both the first and second sides of the recording medium. If the base sheet 11 is formed of an opaque material, double-sided printing is possible by forming different images on the first and second sides.

In order to obtain a color image of good quality, the print start locations of the first and second sides must be correctly matched with each other. Thus the yellow, magenta and cyan images printed on the first and second sides must correctly overlap. When the recording head 51 is positioned at the first and second locations, the contact state between the heating part 59 and the platen roller 52 must be identical. If so, the image quality printed on the first and second sides becomes uniform. Thus good quality images can be obtained.

In order to correctly match the print start locations of the first and second sides and make the contact state between the heating part 59 and the platen roller 52 identical to each other, the position of the heating part 59 is symmetrical with a reference line L1 when the recording head 51 is positioned at the first location and the second location. Here, the reference line L1 is a line that connects the conveying part 40 and the center 52*a* of the platen roller 52. In this case, a distance between the heating part 59 and the conveying part 40, when the recording head 51 is positioned at the first location, is identical to a distance between the heating part 59 and the conveying part 40 when the recording head 51 is positioned at the second location. Therefore, it is relatively easy to match the print start locations. The conveying part 40 includes a pair of rotatably engageable rollers 41 and 42. At this time, the reference line L1 is a line that connects a contact portion 40*a* of the rollers 41 and 42 and the center 52*a* of the platen roller 52.

In more detail, if a sensor 43 detects a front end of the recording medium 10, fed from the first path when the recording head 51 is positioned at the first location, then the conveying part 40 conveys the recording medium 10 in the second direction for a predetermined period of time. At this time, the recording medium 10 reaches the print start location. Also, if the sensor 43 detects a front end of the recording medium 10 fed from the third path, when the recording head 51 is positioned at the second location, then the conveying part 40 conveys the recording medium 10 in the second direction for the predetermined period of time. At this time, the recording medium 10 reaches the print start location. As indicated by dotted lines of FIGS. 1 and 2, if the sensor 43 is positioned at an inlet side of the platen roller 52, when the sensor 43 detects an end of the recording medium 10, fed from the first path, when the recording head 51 is positioned at the first location, then the conveying part 40 conveys the recording medium 10 in the second direction for a predetermined period of time. The recording medium 10 reaches the print start location. Also, when the sensor 43 detects an end of the recording medium 10, fed from the third path, when the recording head 51 is positioned at the second location, then the conveying part 40 conveys the recording medium 10 in the second direction for the predetermined period of time. At this time, the recording medium 10 reaches the print start location. Accordingly, the print start locations can be precisely matched by a simple control method.

In this exemplary embodiment, the recording head 51 rotates around the platen roller 52 and moves to the first and second locations. Therefore, it is preferable that the rotation center of the recording head 51 be positioned at the center 52*a* of the platen roller 52. For example, if the first and second locations of the recording head 51 are spaced apart from each other by about 180°, the heating part 59 must be correctly positioned on the line L2, which passes through the center 52*a* of the platen roller 52, when the recording head 51 is positioned at the first location, as indicated by a dotted line of FIG. 3. Even when the recording head 51 is positioned at the second location, the heating part 59 is positioned at the line L2, which passes through the center 52*a* of the platen roller 52, so that it is symmetrical with the reference line L1.

Figure 3:
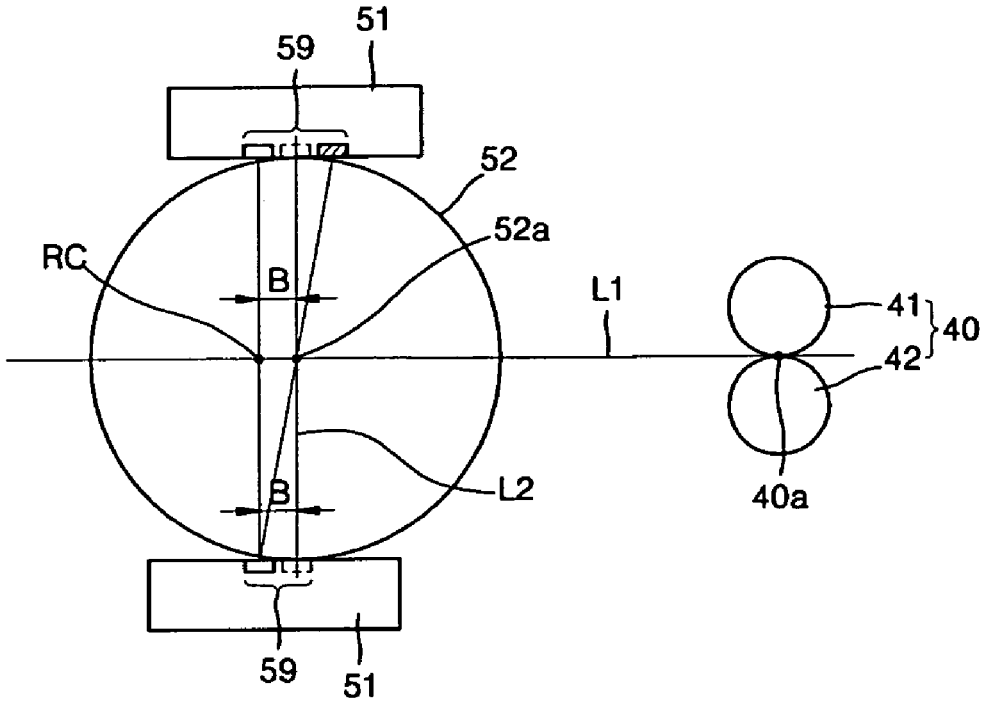
FIGS. 3 and 4 illustrate the rotational center of a recording head of FIGS. 1 and 2.

However, the heating part 59 may have a location deviation B due to a manufacturing error or assembling error of elements of the image forming apparatus. That is, as indicated by a solid line of FIG. 3, when the recording head 51 is positioned at the first location, the heating part 59 may be misaligned with the line L2 passing through the center 52*a* of the platen roller 52. If the recording head 51 rotates around the center 52*a* of the platen roller 52 by about 180° and is positioned at the second location, the location of the heating part 59 is a point symmetrical to that when the heating part 59 is positioned at the first location with respect to the center 52*a* of the platen roller 52. This is illustrated in FIG. 3 by hatching. If this is the case, the distance between the heating part 59 and the conveying part 40 when the recording head 51 is positioned at the first location is different from the distance between the heating part 59 and the conveying part 40 when the recording head 51 is positioned at the second location.

In order to solve these problems, the image forming apparatus according to exemplary embodiments of the present invention moves the location of the rotation center RC of the recording head 51 along the reference line L1 by the location deviation B of the heating part 59. That is, as shown in FIG. 3, the rotation center of the recording head 51 is moved from the center 52*a* of the platen roller 52 along the reference line L1 by the location deviation B. If so, the location of the heating, part 59 when the recording head 51 is positioned at the first location is symmetrical with the location of the heating part 59 when the recording head 51 is positioned at the second location with respect to the reference line L1. Accordingly, the distance between the heating part 59 and the conveying part 40, when the recording head 51 is positioned at the first location, is identical to the distance between the heating part 59 and the conveying part 40 when the recording head 51 is positioned at the second location. Therefore, manufacturing and assembling errors of the elements of the image forming apparatus become constant in a stabilization step. Thus, the location deviation B of the heating part 59 becomes constant and the location of the rotation center RC of the recording head 51 also becomes constant.

Figure 4:
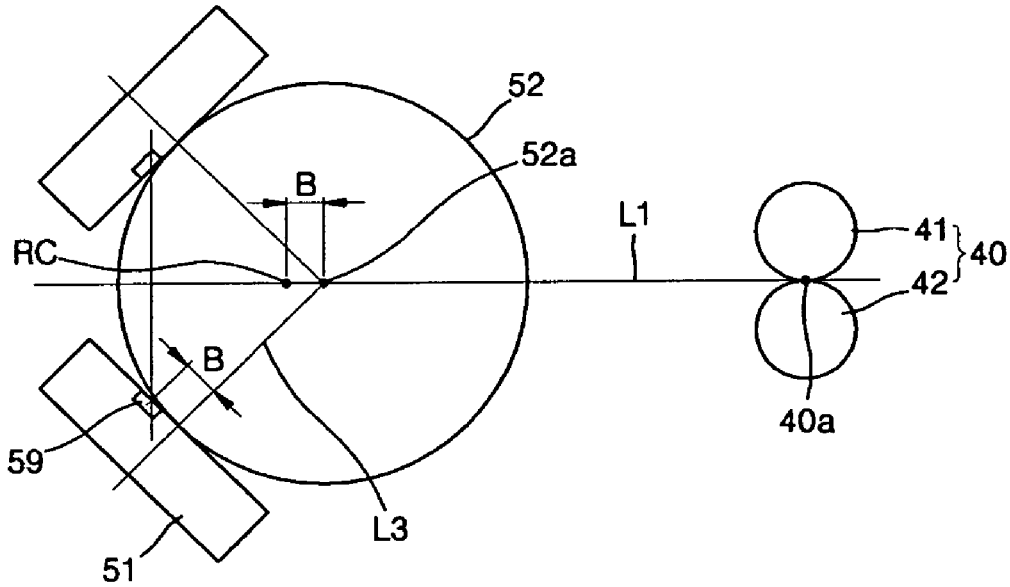

Such a movement of the rotation center RC is not limited to the case where the first and second locations of the recording head 51 are spaced apart from each other by 180°. For example, as shown in FIG. 4, when the first and second locations of the recording head 51 are spaced apart from each other by about 120°, the location that is spaced apart from the center 52*a* of the platen roller 52 along the reference line L1 by the location deviation B of the heating part 59 with respect to a normal line L3 becomes the rotation center RC of the recording head 51. Here, the normal line L3 is a line connecting the center 52*a* of the platen roller 52 and the heating part 59 when the recording head 51 is positioned at the first location.

In FIGS. 1 and 2, the support bracket 53 rotates around the location spaced apart from the center 52*a* of the platen roller 52 by the location deviation B.

In order to form the image on both sides of the recording medium 10, the recording head 51 rotates around the platen roller 52 and the recording medium 10 is reciprocated two times through the straight path. Since the recording medium 10 is conveyed along a very simple path while the image is printed on both sides of the recording medium 10, the probability that the recording medium 10 will jam is relatively low. Also, the rotation center RC of the recording head 51 is eccentrically moved from the center of the platen roller 52 in consideration of the location deviation B of the heating part 59. Therefore, the location of the heating part 59 when the recording head 51 is positioned at the first location is symmetrical to the location of the heating part 59 when the recording head 51 is positioned at the second location with respect to the reference line L1. By a simple control method, the print start locations can be correctly matched when the recording head 51 is positioned at the first and second locations. Thus, a color image of good quality can be obtained.

Figure 5:
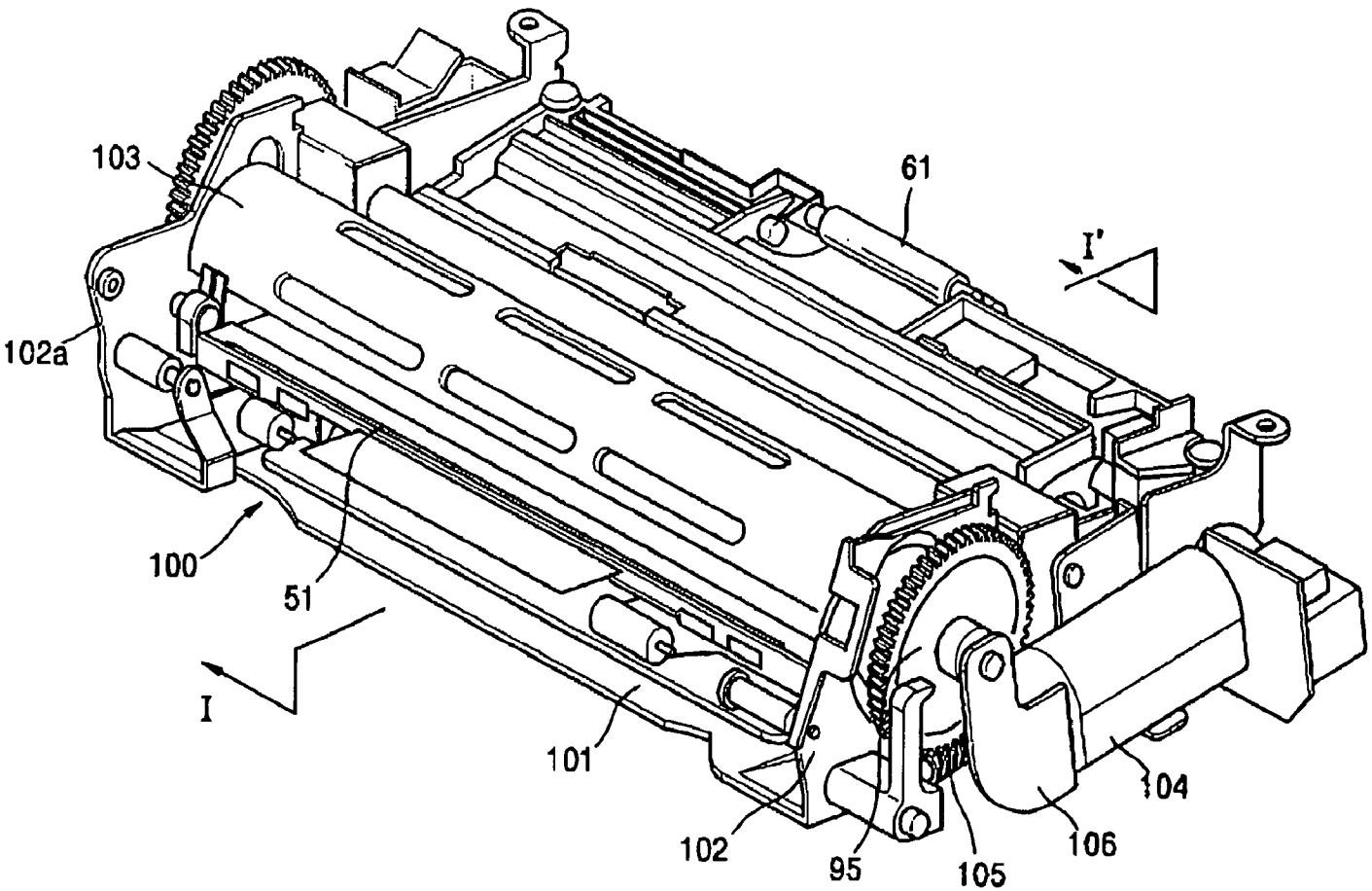
FIG. 5 is a perspective view illustrating a thermal image forming apparatus according to an embodiment of the present invention.
Figure 6:
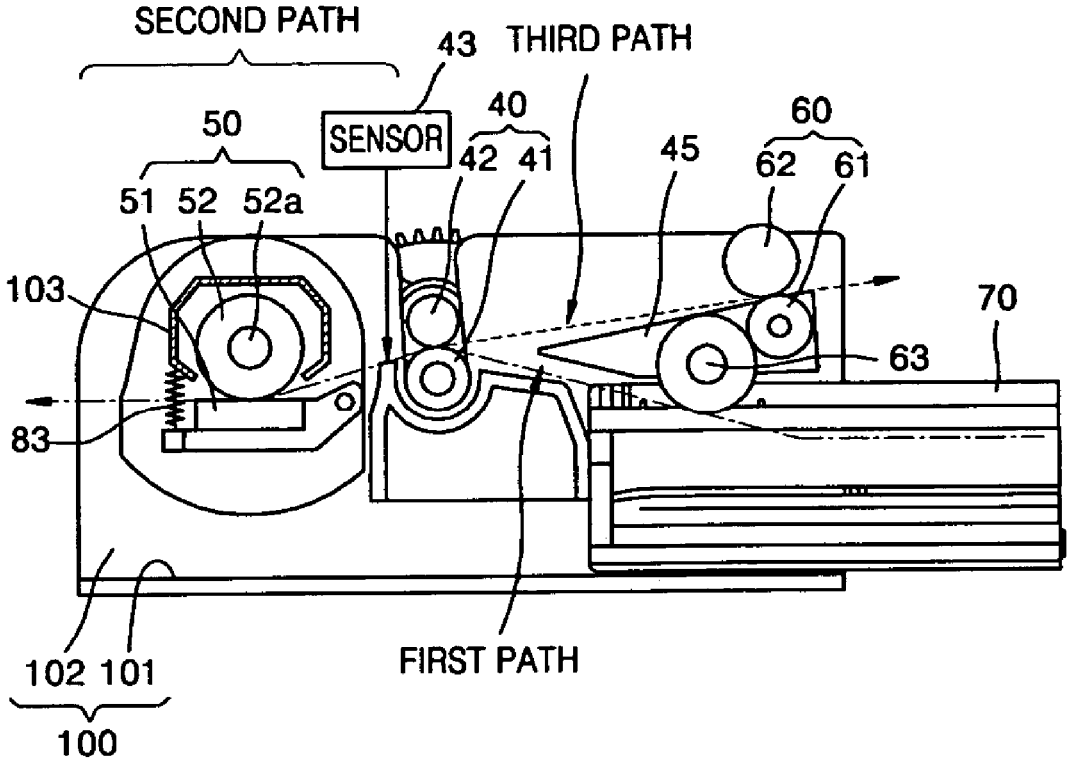
FIG. 6 is a sectional view taken along line I-I' of FIG. 5.
Figure 7:
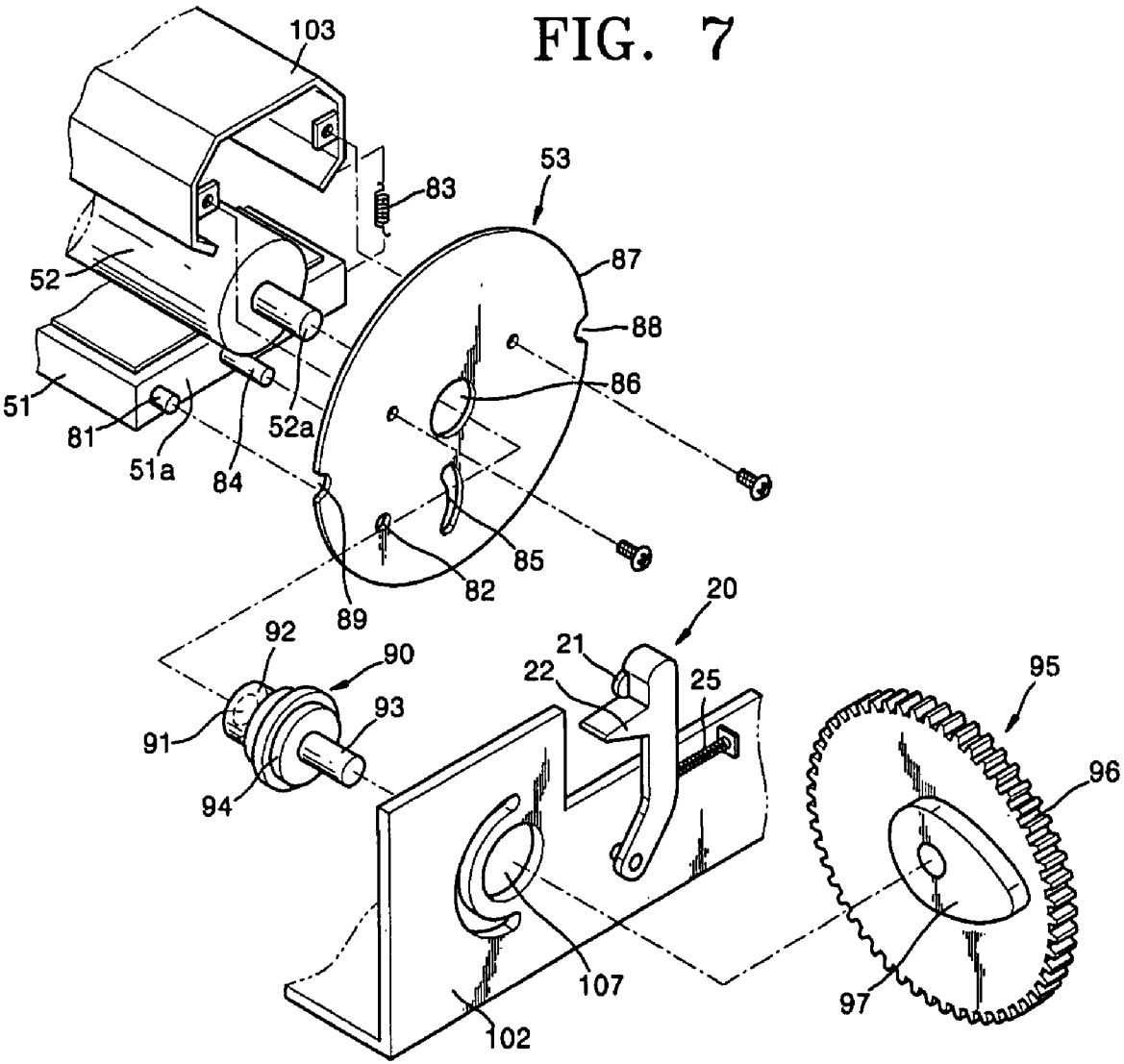
FIG. 7 is an exploded perspective view illustrating a rotational structure of a recording head.

FIG. 5 is a perspective view of the thermal image forming apparatus according to an exemplary embodiment of the present invention. FIG. 6 is a sectional view taken along line I-I' of FIG. 5. FIG. 7 is an exploded perspective view of a rotating structure of the recording head.

Referring to FIGS. 5 and 6, a frame 100 includes a lower base 101 and two side plates 102 and 102*a* disposed upright on both sides of the lower base 101. The cassette 70, into which the recording medium 10 is loaded, is mounted on one side of the frame 100. A pick-up roller 63 for picking up the recording medium 10 from the cassette 70 is provided at an upper side of the cassette 70. The discharge part 60 for discharging the printed recording medium is provided at an upper side of the pick-up roller 63. The discharge part 60 includes a discharge roller 61 and an idle roller 62 engaged therewith. In this embodiment, the pick-up roller 63 and the discharge roller 61 are in contact with each other and are driven by one drive motor (not shown). The drive motor (not shown) may be coupled to the side plate 102*a*. The recording head 51 and the platen roller 52 are provided at a side opposite to the discharge part 60 between the two side plates 102 and 102*a*. The conveying part 40 conveys the recording medium 10. The conveying part 40 includes a pair of rollers 41 and 42, which are elastically engaged with each other. A torque of the drive motor is transferred to only one of the rollers 41 and 42, and the other roller is driven.

As shown in FIGS. 1 and 2, the above-described structure defines the first path from the cassette 70 to the conveying part 40, the second path from the conveying part 40 to the image forming part 50, and the third path from the conveying part 40 to the discharge part 60. The recording medium guide 45 separates the first path from the third path.

Referring to FIG. 7, a hinge shaft 81 is provided at a side portion 51*a* of the recording head 51 and a hinge hole 82 is formed at the support bracket 53. The hinge shaft 81 is inserted into the hinge hole 82 so that the recording head 51 is rotated around the hinge hole 82 of the support bracket 53. A rotation guide 103 is coupled to the support bracket 53. A second elastic member 83 elastically biases the recording head 51 in a direction which comes into contact with the platen roller 52. As shown in FIG. 7, a tension coil spring having one end coupled to the recording head 51 and the other end coupled to a cover 103 enclosing the platen roller 52 can be used as the second elastic member 83.

One end of the shaft 84 is coupled to the recording head 51 and the other end is inserted into a through hole 85 formed at the support bracket 53. Preferably, the through hole 85 is formed as a long opening shaped so as to allow the recording head 51 to move in a direction for contacting with the platen roller 52 or in a direction being separated from the platen roller 52. Also, preferably, the through hole 85 is formed in an substantially arcuate shape centered around the hinge hole 82. The recording head 51 moves into contact with the platen roller 52 and separates from the platen roller 52 by its rotation around the hinge hole 82. In this embodiment, the platen roller 52 is not directly coupled to the drive motor (not shown). As the recording medium 10 is fed by the conveying part 40, the platen roller 52 moves into contact with the recording medium 10 so that it is driven and rotated. Of course, the platen roller 52 may also be directly connected to the drive motor (not shown).

As described in FIGS. 3 and 4, a pair of bushings 90 are also provided and include an inner circumference portion 91 and a first outer circumference portion 92 whose rotation center is moved by the location deviation B. The center 52*a* of the platen roller 52 is inserted into the inner circumference portion 91. The first outer circumference portion 92 is rotatably inserted into a support hole 86 formed at the support bracket 53. The bushing 90 further includes a second outer circumference portion 94 whose center is identical to that of the first outer circumference portion 92. A rotation cam 95 is rotatably coupled to the third outer circumference portion 94. The rotation cam 95 includes a gear 96 and a cam 97 which comes into contact with the shaft 84. A motor (104 in FIG. 5) includes a worm gear 105 engaged with the gear 96. The motor 104 is coupled to a bracket 106 and the bracket 106 is coupled to the side plate 102. The second outer circumference portion 93 of the bushing 90 is inserted into a hole 107 formed at the side plate 102, and an end of the third outer circumference portion 94 is supported by the bracket 106. The bracket 106 prevents the rotation cam 95 from being released from the third outer circumference portion 94. It is preferable that a center of the first outer circumference portion 92 is equal to that of the third outer circumference portion 93. Due to this structure, the support bracket 53 and the rotation cam 95 can be concentrically configured. This rotation center becomes the rotation center RC of the recording head 51. The support bracket 53 has a circular outer circumference 87 and first and second locking grooves 88 and 89 are arranged on the outer circumference 87 at about 180° from each other. The locking member 20 is rotatably coupled to the side plate 102. The first elastic member 25 applies an elastic force to the locking member 20 in a direction for coupling to the first and second locking grooves 88 and 89. In this embodiment, the locking member 20 unlocks from the first and second locking grooves 88 and 89 by the rotation cam 95 and is locked thereto by the elastic force of the first elastic member 25. The locking member 20 has a protrusion 21 to lock the first and second locking grooves 88 and 89, and an interference portion 22 to interfere with the cam 97 of the rotation cam 95. Although not illustrated in the drawings, the support bracket 53 is rotatably coupled on the side plate 102*a*. The support bracket 53 rotates around the location spaced apart from the center 52*a* of the platen roller 52 by the location deviation B.

FIGS. 8A through 8I are sectional views illustrating a rotating operation of the recording head. Although not illustrated in detail, the rotation centers of the rotation cam 97 and the support bracket 53 are spaced apart from the center 52*a* of the platen roller 52 by the location deviation B. The printing operation of the thermal image forming apparatus according to exemplary embodiments of the present invention will now be described with reference to FIGS. 1 through 4 and FIGS. 8A through 8I.

Figure 8A:
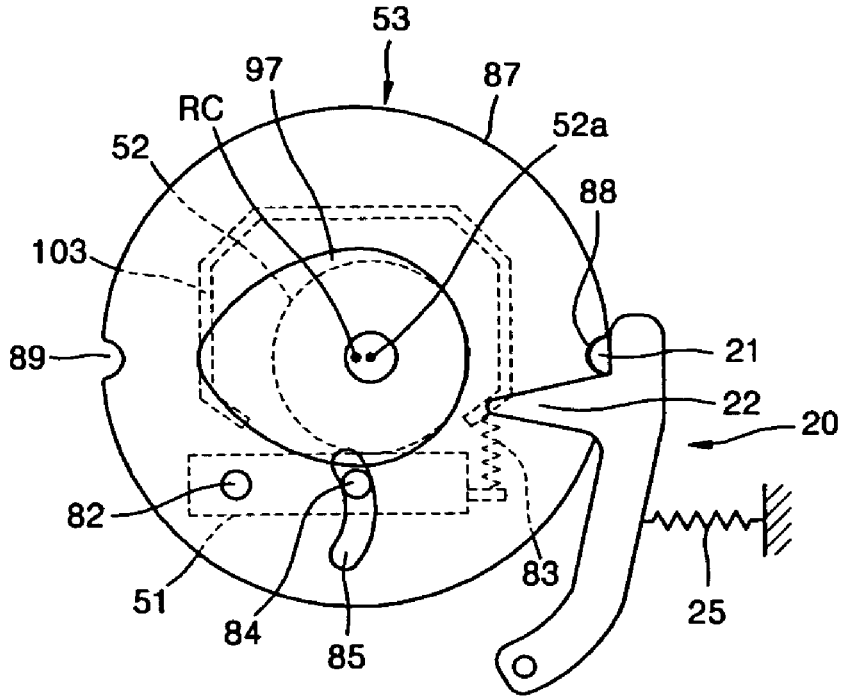
FIGS. 8A through 8I are views illustrating a rotating operation of a recording head.

Referring to FIGS. 8A, the recording head 51 moves into contact with the platen roller 52 by pressure. Also, the protrusion 21 of the locking member 20 engages with the first locking groove 88. Thus, the recording head 51 is locked to the first location. The recording medium 10 is fed from a feed cassette 70 by the pick-up roller 63 and is conveyed to the conveying part 40 through the first path. Before the recording medium 10 is conveyed to the second path, or before the recording medium 10 is picked up by the pick-up roller 63, it is preferable that the recording head 51 separates from the platen roller 52.

Figure 8B:
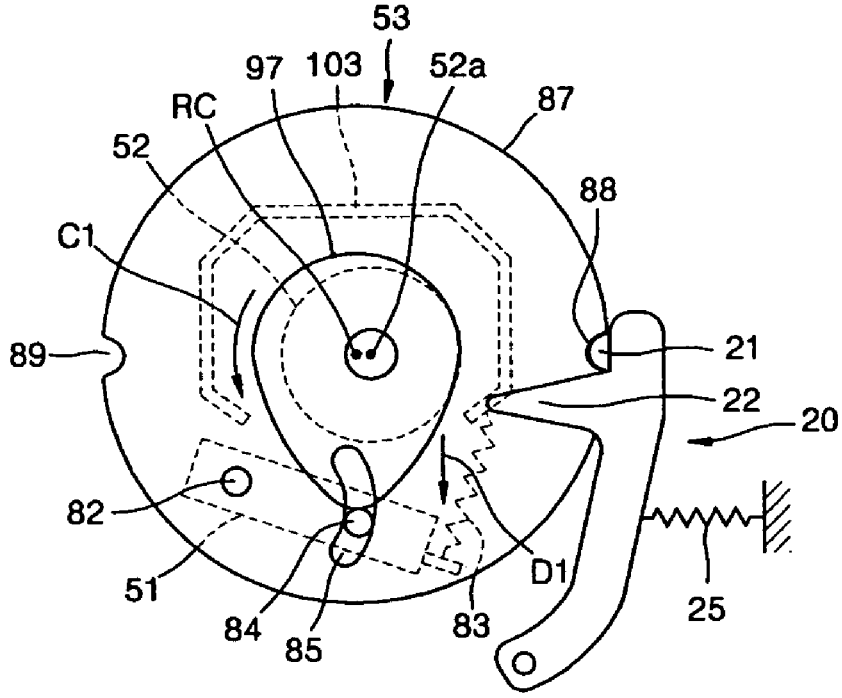

Referring to FIG. 8B, the rotation cam 95 rotates in a direction indicated by an arrow "C1" and the cam 97 pushes the shaft 84. The support bracket 53 does not rotate because the protrusion 21 of the locking member 20 is locked to the first locking groove 88. As the shaft 84 is pushed along the through hole 85, in a direction indicated by an arrow "D1", the recording head 51 rotates around the hinge hole 82. Consequently, the recording head 51 separates from the platen roller 52. At this time, the conveying part 40 conveys the recording medium 10 toward the second path. Since the recording head 51 separates from the support member 52, the recording medium 10 enters between the recording head 51 and the platen roller 52 without any resistance even when the platen roller 52 does not rotate.

Figure 8C:
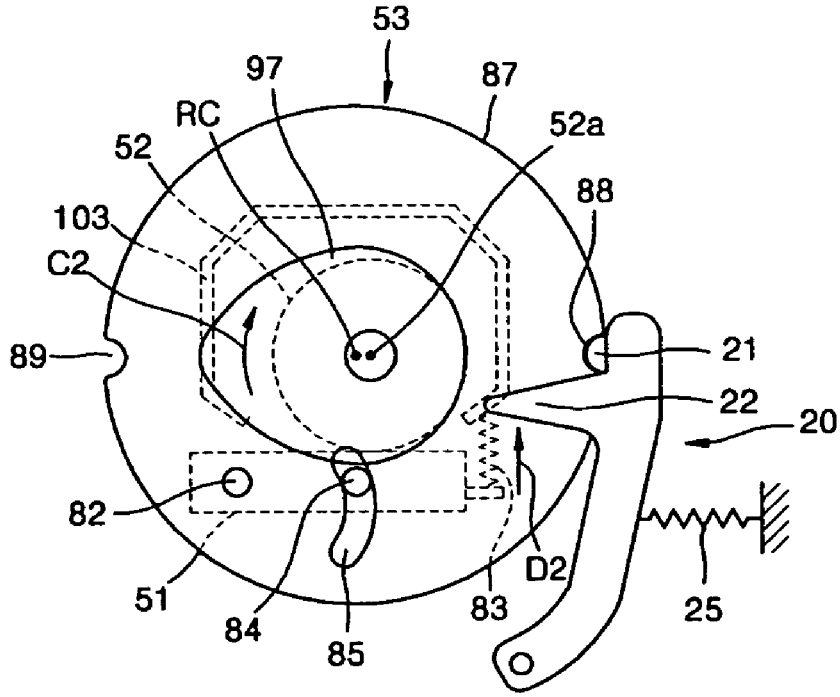

If the sensor 43 detects the front end of the recording medium 10 and the recording medium 10 is conveyed to a predetermined print start location after a predetermined time, the conveying part 40 stops conveying the recording medium 10. Referring to FIG. 8C, the rotation cam 95 rotates in a direction indicated by an arrow C2. Since the protrusion 21 of the locking member 20 is locked to the first locking groove 88, the support bracket 53 does not rotate. Due to the elastic force of the second elastic member 83, the recording head 51 rotates around the hinge hole 82 in a direction indicated by an arrow "D2." Thus, the recording head 51 elastically contacts the platen roller 52.

Then, the conveying part 40 begins to convey the recording medium 10 toward the third path. The recoding head 51 prints images, such as magenta or yellow images, by applying heat upon the first side of the recording medium 10. The magenta color and yellow color can be selectively reproduced depending on temperature and heating time of the recording head 51. For example, the magenta color can be reproduced under conditions of a high temperature and a short heating time, and the yellow color can be reproduced under conditions of a low temperature and a relatively long heating time. When the printing on the first side of the recording medium 10 is finished, the recording medium 10 escapes from the second path and is positioned at the third path. The conveying part 40 stops conveying the recording medium 10.

Figure 8D:
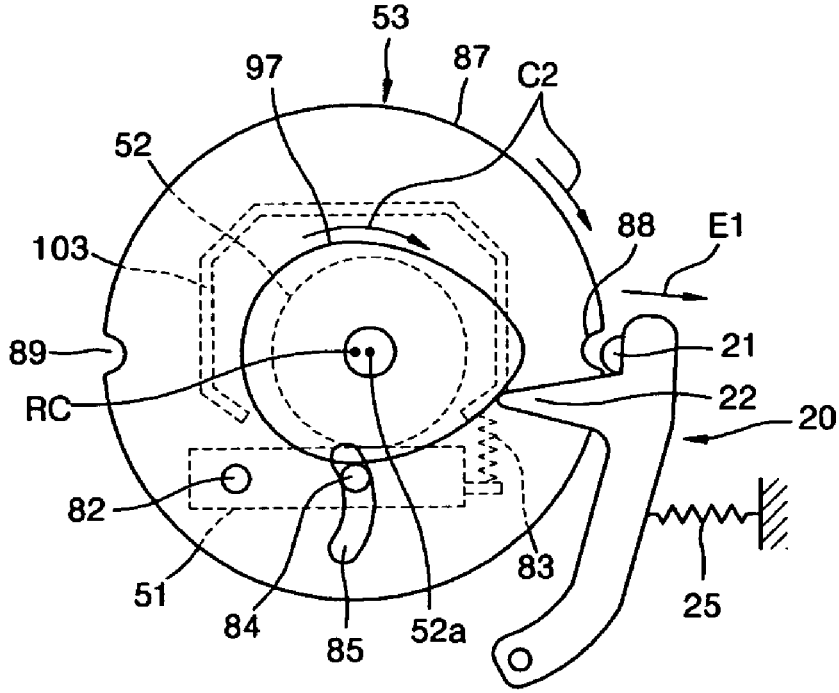
Figure 8E:
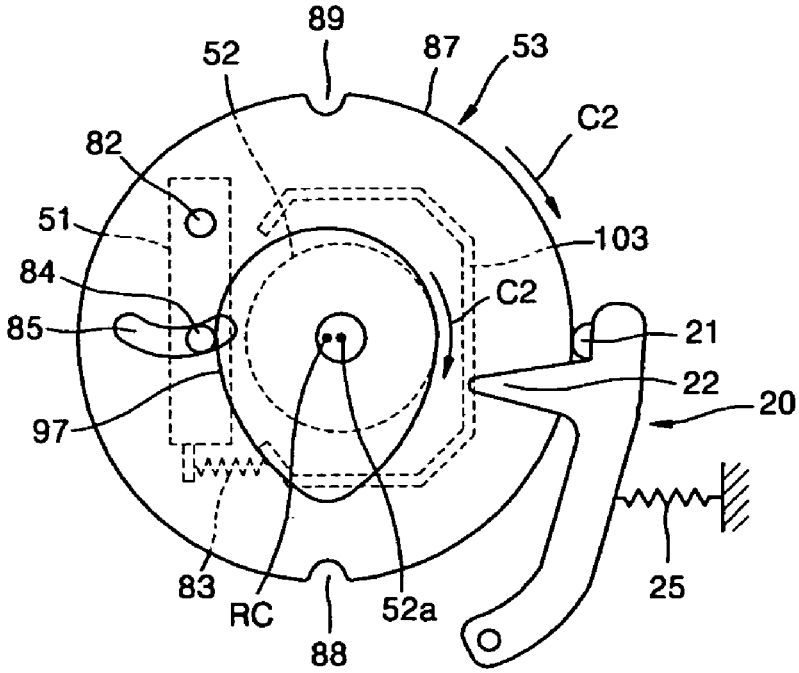

Then, an operation of moving the recording head 10 toward the second location is performed so as to print an image on the second side of the recording medium 10. Referring to FIG. 8D, the rotation cam 95 rotates in a direction indicated by an arrow "C2", the cam 97 pushes the interference portion 22 so that the locking member 20 rotates in a direction indicated by an arrow "E1". The protrusion 21 is released from the first locking groove 88 and the support bracket 53 is set free so as to be freely rotatable. Accordingly, when the cam 97 continuously rotates in a direction indicated by the arrow "C2," the cam pushes the shaft 84 and the support bracket 53 rotates in a direction indicated by an arrow "C2", as shown in FIG. 8E, rather the recording head 51 separates in a direction indicated by the arrow "D1". While the support bracket 53 is rotating in a direction indicated by an arrow "C2", the cam 97 pushes the shaft 84 so that the recording head 51 slightly separates from the platen roller 52. When the interference between the cam 97 and the interference portion 22 is finished, the locking member 20 maintains contact with the outer circumference 87 of the support bracket 53 by the elastic force of the first elastic member 25.

Figure 8F:
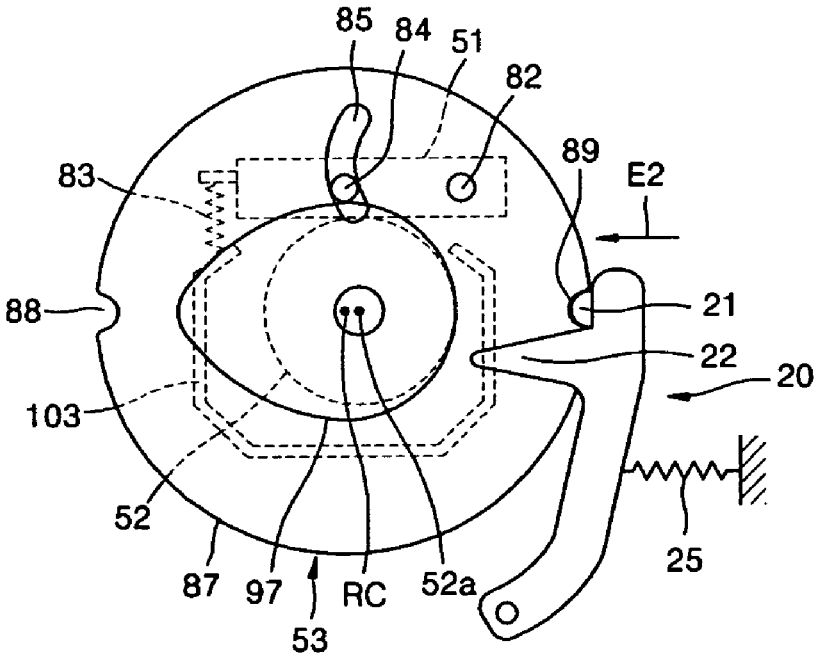

Referring to FIG. 8F, if the support bracket 53 rotates by about 180°, the elastic force of the first elastic member 25 causes the locking member 20 to rotate in a direction indicated by an arrow "E2." Thus, the protrusion 21 is locked to the second locking groove 89. Also, the support bracket 53 is locked and thus does not rotate. The recording head 51 reaches the second location facing the second side of the recording medium 10. The rotation center of the recording head 51 is eccentric from the center 52*a* of the platen roller 52 by the location deviation B of the heating part 59. Therefore, the location of the heating part 59, when the recording head 51 is positioned at the first location, is symmetrical with the location of the heating part 59 when the recording head 51 is positioned at the second location with respect to the reference line L1. Thus, the distance between the heating part 59 and the conveying part 40, when the recording head 51 is positioned at the first location, is identical to the distance between the heating part 59 and the conveying part 40 when the recording head 51 is positioned at the second location.

Figure 8G:
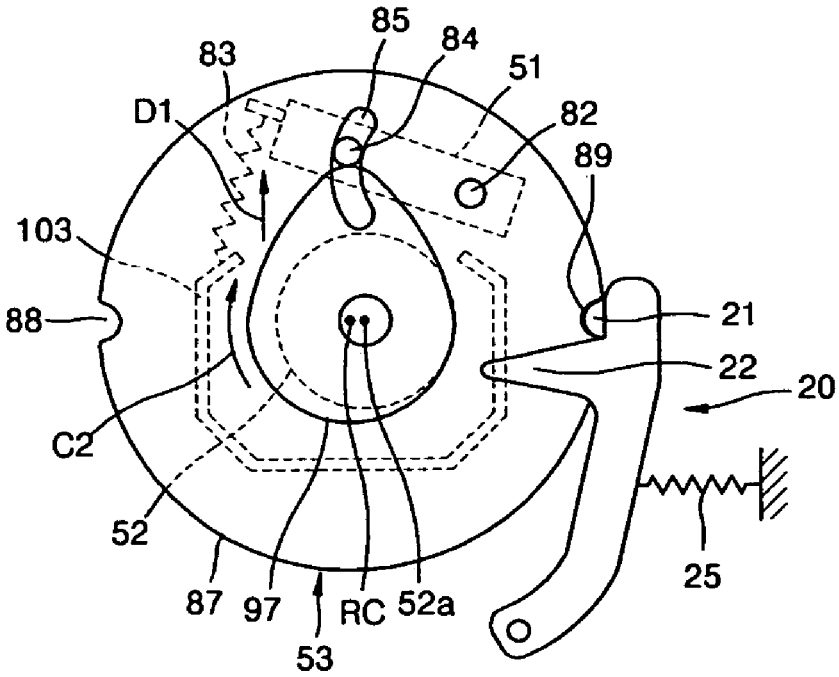

If the rotation cam 95 continues to rotate in a direction indicated by the arrow "C2," the support bracket 53 does not rotate because the protrusion 21 is locked to the second locking groove 89. Referring to FIG. 8G, the shaft 84 is pushed along the through hole 85 and the recording head 51 separates from the platen roller 52.

Figure 8H:
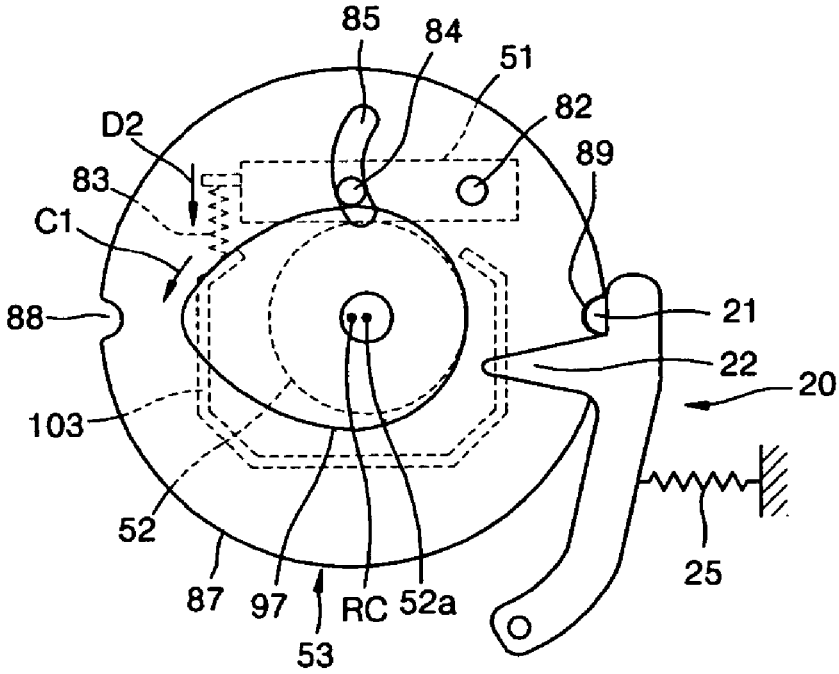

In this state, the conveying part 40 conveys the recording medium 10 from the third path to the second path. When the sensor 43 detects the front end of the recording medium 10, the recording medium 10 reaches the print start location after the same time elapses, and the conveying part 40 stops conveying the recording medium 10. If the rotation cam 95 rotates in the direction indicated by the arrow "C1," the support bracket 53 does not rotate because the protrusion 21 is locked to the second locking groove 89. Instead, the shaft 84 moves backward along the through hole 85 as shown in FIG. 8H, and the recording head 51 moves into contact with the platen roller 52.

The conveying part 40 again conveys the recording medium 10 toward the third path. The recording head 51 prints cyan images on the second side of the recording medium 10 by applying heat thereto. After the printing on the first and second sides is finished, the recording medium 10 is discharged out of the image forming apparatus by the discharge part 60.

Figure 8I:
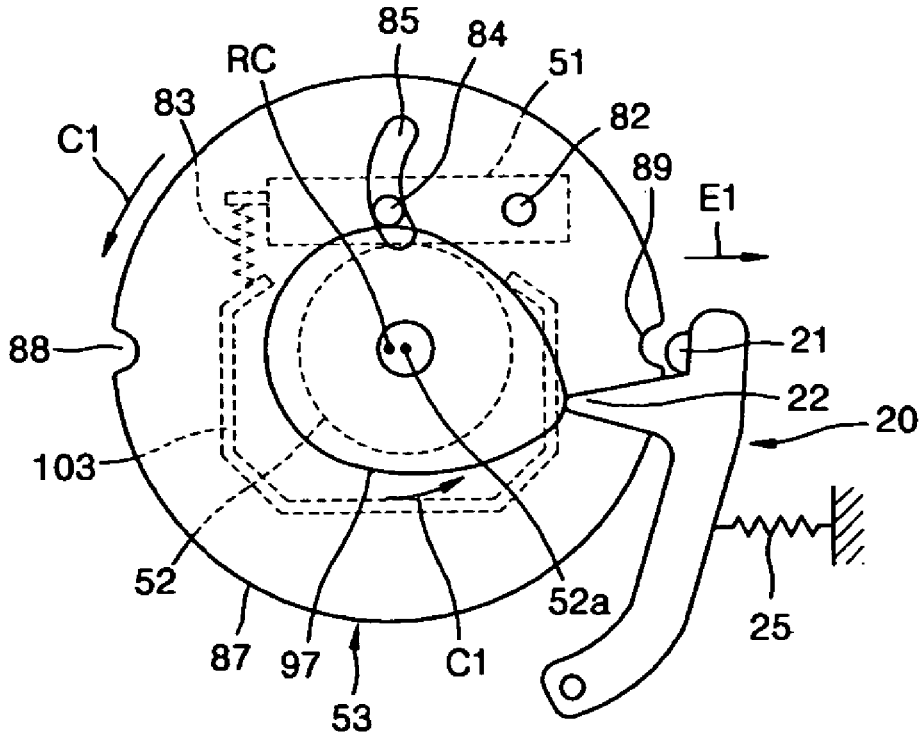

Referring to FIG. 8I, when the printing operation is complete, the rotation cam 95 rotates in a direction indicated by the arrow "C1." The cam 97 pushes the interference portion 22 so that the locking member 20 rotates in a direction indicated by the arrow "E1". In that case, the protrusion 21 separates from the second locking groove 89 and the support bracket 53 is freely rotatable. If the cam 97 pushes the shaft 84, the support bracket 53 rotates until the protrusion 21 locks into the first locking groove 88 by the elastic force of the first elastic member 25. As shown in FIG. 8A, the recording head 51 returns back to the first location. In this status or as shown in FIG. 8B, the recording head 51 can be ready for a next printing operation, while separated from the platen roller 52.

If the base sheet 11 of the recording medium 10 is formed of a transparent material, cyan, magenta and yellow images are overlapped together to reproduce full color images. Also, if the base sheet 11 is formed of an opaque material, double-sided printing is possible by forming different images on the first and second sides of the recording medium.

As described above, considering the location deviation of the heating part, the rotation center of the recording head is eccentric from the center of the platen roller. Thus, images can be uniformly printed on both sides. Also, when the color images are printed, the images printed on both sides are correctly overlapped so that good color image quality can be obtained. Further, since the recording head rotates, the transfer path of the recording medium is simplified. Therefore, compared with the conventional printer, mechanical troubles seldom occur in the image forming apparatus and the printer can be scaled down.

While the present invention has been particularly shown and described with reference to exemplary embodiments thereof, it will be understood by those of ordinary skill in the art that various changes in form and details may be made therein without departing from the spirit and scope of the exemplary embodiments of the invention as defined by the appended claims.

What is claimed is:

1. A thermal image forming apparatus comprising:

a platen roller which supports a recording medium, the recording medium having first and second sides opposite to each other;

a recording head which includes a heating part that applies heat to the recording medium for image formation, the recording head rotates around the platen roller to move the heating part to first and second locations respectively facing the first and second sides of the recording medium; and a conveying part which conveys the recording medium, wherein when the recording head is positioned at the first and second locations, locations of the heating part are symmetrical with each other with respect to a reference line, the reference line passing through the conveying part and a center of the platen roller.

2. The apparatus of claim 1, wherein a rotational center of the recording head is positioned at a location that is eccentric from the center of the platen roller along the reference line by a distance corresponding to a location deviation of the heating part with respect to a normal line connecting the center of the platen roller and the heating part.

3. The apparatus of claim 1, wherein the second location is positioned at a location that is rotated from the first location by about 180°.

4. The apparatus of claim 1, wherein the conveying part includes a drive roller and a driven roller which rotate in engagement with each other, and the reference line is a line connecting the center of the platen roller and a contact portion between the drive roller and the driven roller.

5. The apparatus of claim 1, further comprising:

a first path through which the recording medium is initially fed;

a second path in which the recording head and the platen roller are arranged; and a third path which branches from a connecting portion of the first and second paths converge and through which the recording medium is discharged after printing is finished, wherein the conveying part is arranged in the connecting portion and conveys the recording medium in a first direction so as to form an image thereon or in a second direction so as to match a print start location.

6. The apparatus of claim 1, further comprising:

a pair of bushings having an inner circumference portion and an outer circumference portion, the inner circumference portion rotatably supports the platen roller, the outer circumference portion being eccentric from the inner circumference portion by a location deviation at the first location of the heating part;

a pair of support brackets rotatably arranged in the outer circumference portion of the bushings, the support brackets supporting both ends of the recording head;

a shaft having one end coupled to the recording head and the other end inserted into a through hole formed at the support bracket;

a motor; and a rotation cam rotated by the motor, the rotation cam pushing the shaft to rotate the support bracket.

7. The apparatus of claim 6, wherein the bushing further comprises a second outer circumference portion that is concentric with the first outer circumference portion, wherein the rotation cam is rotatably arranged in the second outer circumference portion.

8. The apparatus of claim 7, further comprising:

first and second locking grooves provided at the support bracket;

a locking member selectively coupled to the first and second locking grooves to lock the recording head to positions facing the first and second sides of the recording medium;

a first elastic member which elastically biases the locking member in a direction coupling to the first and second locking grooves; and a second elastic member which elastically biases the recording head in a direction coming into contact with the platen roller, wherein the recording head is coupled to the support bracket so that the recording head moves in a direction coming into contact with the platen roller or in a direction away from the platen roller;

the through hole is formed in a substantially arcuate shape centering on a rotating axis of the recording medium; and when the locking member is locked into the first or second locking grooves, the rotation cam comes into contact with the shaft so that the recording head moves into contact with the platen roller or separates from the platen roller, and when the locking member unlocks from the first or second locking grooves, the rotation cam comes into contact with the shaft and rotates the support bracket.

9. A thermal image forming apparatus comprising:

a platen roller which supports a recording medium, the recording medium having first and second sides opposite to each other;

a recording head which includes a heating part that applies heat to the recording medium for image formation, the recording head rotates around the platen roller to move the heating part to first and second locations respectively facing the first and second sides of the recording medium;

a first path through which the recording medium is initially fed;

a second path in which the recording head and the platen roller are arranged;

a third path which branches from a connecting portion of the first and second paths converge and through which the recording medium is discharged after printing is finished; and a conveying part which conveys the recording medium, wherein when the recording head is positioned at the first and second locations, locations of the heating part are symmetrical with each other with respect to a reference line, the reference line passing through the conveying part and a center of the platen roller.

10. The apparatus of claim 9, wherein a rotational center of the recording head is positioned at a location that is eccentric from the center of the platen roller along the reference line by a distance corresponding to a location deviation of the heating part with respect to a normal line connecting the center of the platen roller and the heating part.

11. The apparatus of claim 10, wherein the second location is positioned at a location that is rotated from the first location by about 180°.

12. The apparatus of claim 10, wherein the conveying part is arranged in the connecting portion and conveys the recording medium in a first direction so as to form an image thereon or in a second direction so as to match a print start location.

13. The apparatus of claim 12, wherein the conveying part includes a drive roller and a driven roller which rotate in engagement with each other, and the reference line is a line connecting the center of the platen roller and a contact portion between the drive roller and the driven roller.

14. The apparatus of claim 12, further comprising:

a pair of bushings having an inner circumference portion and an outer circumference portion, the inner circumference portion rotatably supports the platen roller, the outer circumference portion being eccentric from the inner circumference portion by a location deviation at the first location of the heating part;

a pair of support brackets rotatably arranged in the outer circumference portion of the bushings, the support brackets supporting both ends of the recording head;

a shaft having one end coupled to the recording head and the other end inserted into a through hole formed at the support bracket;

a motor; and a rotation cam rotated by the motor, the rotation cam pushing the shaft to rotate the support bracket.

15. The apparatus of claim 14, wherein the bushing further comprises a second outer circumference portion that is concentric with the first outer circumference portion, wherein the rotation cam is rotatably arranged in the second outer circumference portion.

16. The apparatus of claim 15, further comprising:

first and second locking grooves provided at the support bracket;

a locking member selectively coupled to the first and second locking grooves to lock the recording head to positions facing the first and second sides of the recording medium;

a first elastic member which elastically biases the locking member in a direction coupling to the first and second locking grooves; and a second elastic member which elastically biases the recording head in a direction coming into contact with the platen roller, wherein the recording head is coupled to the support bracket so that the recording head moves in a direction coming into contact with the platen roller or in a direction away from the platen roller;

the through hole is formed in a substantially arcuate shape centering on a rotating axis of the recording medium; and when the locking member is locked into the first or second locking grooves, the rotation cam comes into contact with the shaft so that the recording head moves into contact with the platen roller or separates from the platen roller, and when the locking member unlocks from the first or second locking grooves, the rotation cam comes into contact with the shaft and rotates the support bracket.

* * * * *